US010724820B1

(12) United States Patent
Zhang

(10) Patent No.: US 10,724,820 B1
(45) Date of Patent: Jul. 28, 2020

(54) SINGLE-SLOT BULLET MAGAZINE PROTECTIVE SLEEVE

(71) Applicant: Cytac Technology Limited, Shenzhen (CN)

(72) Inventor: Yong Zhang, Shenzhen (CN)

(73) Assignee: Cytac Technology Limited, Shenzhen (CN)

( * ) Notice: Subject to any disclaimer, the term of this patent is extended or adjusted under 35 U.S.C. 154(b) by 0 days.

(21) Appl. No.: 16/429,095

(22) Filed: Jun. 3, 2019

(30) Foreign Application Priority Data

Mar. 26, 2019 (CN) ..... 2019 2 0404041 U

(51) Int. Cl.
*F41A 35/02* (2006.01)
*F41A 9/64* (2006.01)

(52) U.S. Cl.
CPC ..... *F41A 35/02* (2013.01); *F41A 9/64* (2013.01)

(58) Field of Classification Search
CPC ..... F41A 35/02; F41A 9/64; F42B 39/26
USPC ..... 42/96
See application file for complete search history.

(56) References Cited

U.S. PATENT DOCUMENTS 3,453,762 A * 7/1969 Fremont ..... F42B 39/00 42/50
4,538,723 A * 9/1985 Johnson ..... F42B 39/26 206/3
10,094,636 B1 * 10/2018 Asbury ..... F41A 9/65
2007/0278269 A1 * 12/2007 Rogers ..... F41A 9/65 224/239
2012/0174452 A1 * 7/2012 Anderson ..... F41A 9/65 42/49.01
2015/0176934 A1 * 6/2015 Shaskan ..... F41A 9/65 89/33.1
2016/0010947 A1 * 1/2016 Barnes ..... F41A 35/02 42/90
2017/0051990 A1 * 2/2017 Purkiss ..... F41A 9/61

* cited by examiner

*Primary Examiner* — Bret Hayes

(57) ABSTRACT

The present disclosure discloses a single-slot bullet magazine protective sleeve, including a first cover body and a second cover body nested together, and a convex block is respectively provided on each side of the second cover body, and a groove matching with the convex block is respectively provided on each side of the first cover body; the first cover body and the second cover body are connected by a first screw passing through the convex block, and a spring is sleeved on the first screw; an elastic piece window is provided on the second cover body, and a pressure elastic piece extending toward the inner side of the second cover body is fixedly mounted in the elastic piece window; a mounting seat is arranged under the elastic piece window, and the mounting seat is fixedly mounted to the first cover body by the second screw.

10 Claims, 3 Drawing Sheets

SINGLE-SLOT BULLET MAGAZINE PROTECTIVE SLEEVE

TECHNICAL FIELD

The present disclosure relates to a protective device, in particular to a single-slot bullet magazine protective sleeve.

BACKGROUND

Firearms are usually barrel firing weapon with a caliber of less than 20 mm, which are used to launch projectiles with gunpowder gas energy. The firearms are commonly used in security guards, sports competitions and other fields. Therein, the bullet clip is an indispensable component of the firearm, and each bullet clip needs to be equipped with a corresponding bullet magazine protective sleeve. At present, each firearm is required to be equipped with a special protective sleeve. Although the protective sleeve and the firearm are well matched, this causes a waste of the protective sleeve. Moreover, after the protective sleeve is used for a long time, the installation of the firearm is unstable and easy to fall off.

In summary, there is a lack of a bullet protective sleeve that can be applied to guns of different sizes in the prior art.

SUMMARY

In order to overcome the above technical problems, the present disclosure provides a single-slot bullet magazine protective sleeve, which has the effects of being easy to disassemble and adapt to different sizes of bullet magazines.

The present disclosure adopts the following solution:

A single-slot bullet magazine protective sleeve, including a first cover body and a second cover body nested together; a convex block is respectively provided on each side of two sides of the second cover body, and a groove corresponding to the convex block is respectively provided on both sides of the first cover body;

the first cover body and the second cover body are connected by a first screw passing through the convex block, and a spring is sleeved on the first screw;

an elastic piece window is provided on the second cover body, a pressure elastic piece extending toward an inner side of the second cover body is fixedly mounted in the elastic piece window; a mounting seat is arranged under the elastic piece window, and the mounting seat is fixedly mounted to the first cover body by a second screw.

Further, a cross section of the convex block is in a circular arc shape.

Further, bottoms of the first cover and the second cover are each provided with an adjustment hole, a third screw is provided inside the adjustment hole.

Further, a length of the adjustment hole is larger than a diameter of the third screw.

Further, a length of the first screw is longer than a length of the second screw.

Further, a stop block is respectively provided on sides of the groove, and the stop block and the convex block are connected by the first screw.

Further, a thickness of the convex block is greater than a thickness of the stop block.

Further, a cross section of the stop block is in a circular arc shape.

Further, the mounting seat is provided with at least two mounting holes that communicate with each other, and the second screw is threadedly engaged with the mounting hole.

Further, a top of the pressure elastic piece is integrally connected to the second cover body.

The advantageous effects of the present disclosure are as below:

(1) The first cover body of the present disclosure is provided with a groove, and the second cover body is provided with a convex block, and the two are engaged, which can increase the connection stability between the cover bodies;

(2) The first screw of the present disclosure is provided with a spring, which facilitates the adjustment of the distance between the first cover body and the second cover body to adapt to different sizes of the bullet magazine.

In the figure: 1. first cover body; 2. second cover body; 3. first screw; 4. pressure elastic piece; 5. convex block; 6. elastic piece window; 7. mounting seat; 8. second screw; 9. adjustment hole; 10. third screw; 11. groove; 12. stop block; 13. spring.

DETAILED DESCRIPTION OF THE EMBODIMENTS

Embodiment 1

Figure 1:
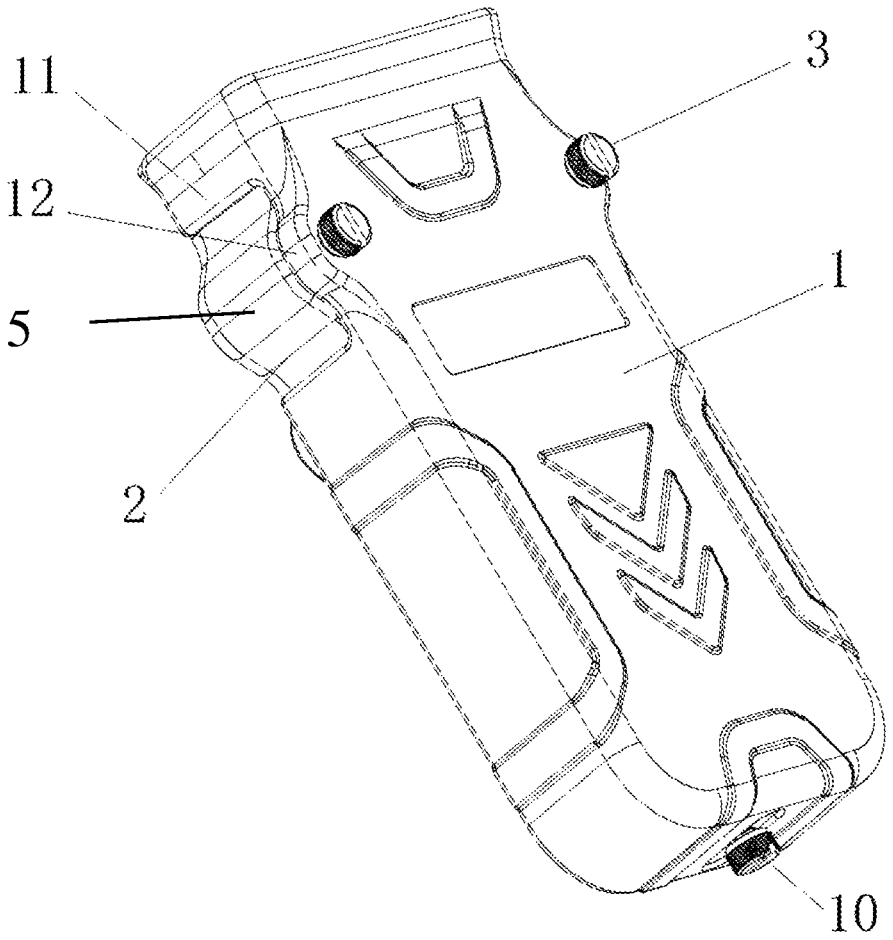
FIG. 1 is a perspective view of the present disclosure.
Figure 2:
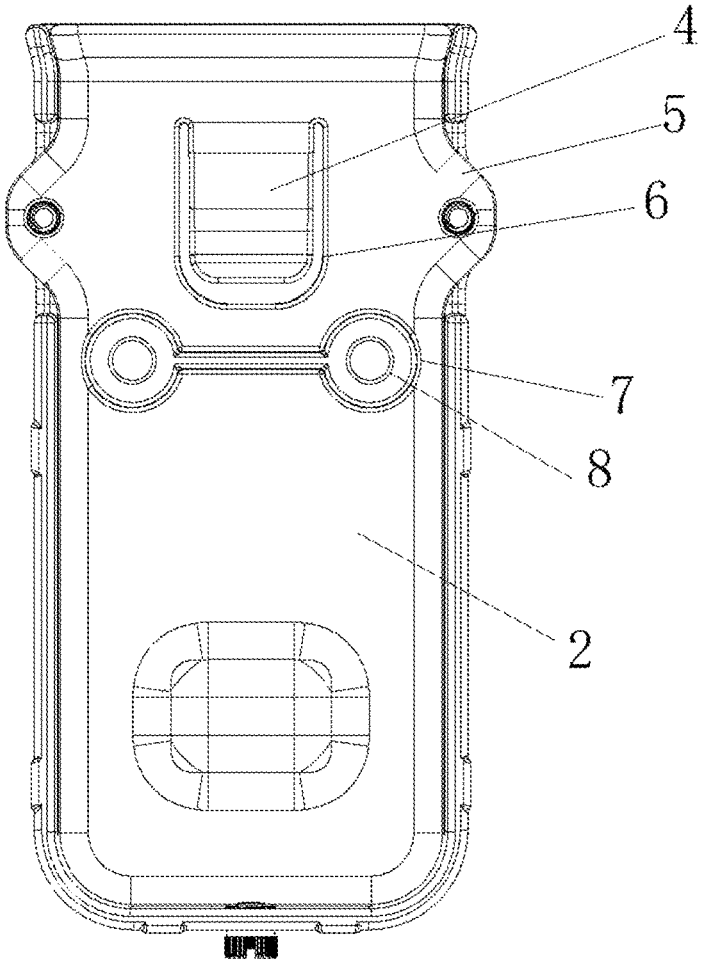
FIG. 2 is a rear view of the present disclosure.
Figure 3:
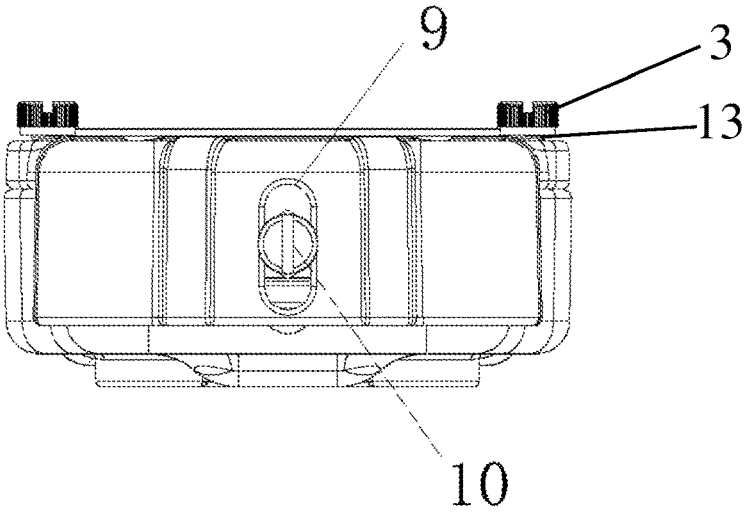
FIG. 3 is a bottom view of the present disclosure.
Figure 4:
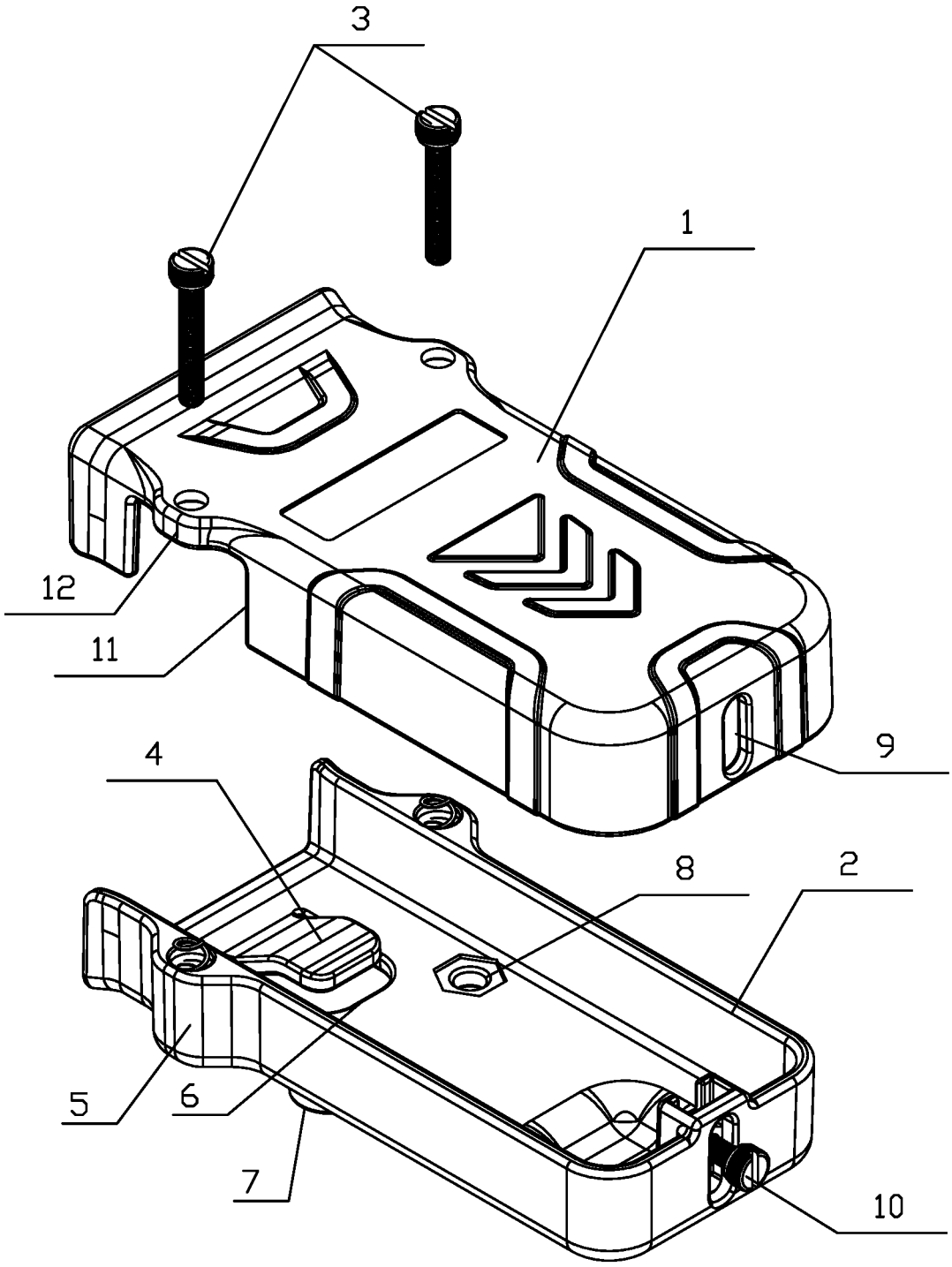
FIG. 4 is an exploded view of the present disclosure.

As shown in FIG. 1 to FIG. 4, the present embodiment provides a single-slot bullet magazine protective sleeve, including a first cover body 1 and a second cover body 2 nested together.

Preferably, the cross section of the stop block 12 is in a circular arc shape, that is to say, the stop block 12 protrudes from the side of the first cover body 1.

The bottom of the first cover body 1 is provided with an adjustment hole 9, and the adjustment hole 9 has a certain length along the thickness direction of the first cover body 1 for adjusting the installation position of the screws.

A convex block 5 is respectively provided on the corresponding position where the stop block 12 is provided of both sides of the second cover body 2, and when the first cover body 1 is connected to the second cover body 2, the convex block 5 is engaged into the groove 11.

Preferably, the cross section of the convex block 5 is in a circular arc shape, and the thickness of the convex block 5 is greater than the thickness of the stop block 12.

Thread holes are respectively provided in the positions of the stop block 12 and the convex block 5 corresponding to each other, and the stop block 12 and the convex block 5 are connected by the first screw 3.

The outer side of the first screw sleeve 3 is provided with a spring in a circumferential direction. The height between the first cover body 1 and the second cover body 2 can be adjusted quickly by the elastic force of the spring, so as to adapt to the different sizes of the magazines.

A elastic piece window 6 is provided on the second cover body 2 at a position between the two convex blocks 5, a pressure elastic piece 4 extending toward an inner side of the second cover body 2 (the space between the first cover body 1 and the second cover body 2) is fixedly mounted in the elastic piece window 6.

The top of the pressure elastic piece 4 is integrally connected to the second cover body 2. The pressure elastic piece 4 makes the inserted clip closely fit between the first cover body 1 and the second cover body 2.

A mounting seat 7 is arranged under the elastic piece window 6, and the mounting seat 7 is fixedly mounted to the first cover body 1 by a second screw 8.

The mounting seat 7 is a structure which is higher than the surface of the second cover body 2, wherein a plurality of mounting holes are provided on the mounting seat 7.

Preferably, the mounting seat 7 includes two mounting holes that communicate with each other, and the mounting holes that communicate with each other are able to increase the tightness of the threaded connection and make the connection between the cover bodies more stable.

The second screw 8 is matched with the mounting hole by thread connection, which is used for preliminary positioning when the first cover body 1 is connected with the second cover body 2.

The length of the first screw 3 is longer than that of the second screw 8.

The bottom of the second cover body 2 is provided with an adjustment hole 9 relative to the first cover body 1, so as to adapt installation of the bullet magazines in different sizes.

The third screw 10 is mounted inside the adjustment hole 9.

When using, the present application can be fixed to a waist protector or belt buckle through a screw. The above description is only a specific embodiment of the present disclosure, and the ordinary skilled in the art can easily conceive changes within the scope of the present disclosure, which is within the scope of protection of the present disclosure.

The invention claimed is:

1. A single-slot bullet magazine protective sleeve, comprising: a first cover body and a second cover body nested together; a convex block is respectively provided on each side of two sides of the second cover body, and a groove corresponding to the convex block is respectively provided on each side of two sides of the first cover body;

the first cover body and the second cover body are connected by a first screw passing through the convex block, and a spring is sleeved on the first screw;

an elastic piece window is provided on the second cover body, a pressure elastic piece extending toward an inner side of the second cover body is fixedly mounted in the elastic piece window; a mounting seat is arranged under the elastic piece window, and the mounting seat is fixedly mounted to the first cover body by a second screw.

2. The single-slot bullet magazine protective sleeve according to claim 1, wherein a cross section of the convex block is in a circular arc shape.

3. The single-slot bullet magazine protective sleeve according to claim 1, wherein bottoms of the first cover and the second cover are each provided with an adjustment hole, a third screw is provided inside the adjustment hole.

4. The single-slot bullet magazine protective sleeve according to claim 3, wherein a length of the adjustment hole is larger than a diameter of the third screw.

5. The single-slot bullet magazine protective sleeve according to claim 1, wherein a length of the first screw is longer than a length of the second screw.

6. The single-slot bullet magazine protective sleeve according to claim 1, wherein a stop block is respectively provided on sides of the groove, and the stop block and the convex block are connected by the first screw.

7. The single-slot bullet magazine protective sleeve according to claim 6 wherein a thickness of the convex block is greater than a thickness of the stop block.

8. The single-slot bullet magazine protective sleeve according to claim 1, wherein a cross section of the stop block is in a circular arc shape.

9. The single-slot bullet magazine protective sleeve according to claim 1, wherein the mounting seat is provided with at least two mounting holes, and the second screw is threadedly engaged with the mounting hole.

10. The single-slot bullet magazine protective sleeve according to claim 1, wherein a top of the pressure elastic piece is integrally connected to the second cover body.

* * * * *